US011384699B2

(12) United States Patent
Sixel et al.

(10) Patent No.: US 11,384,699 B2
(45) Date of Patent: Jul. 12, 2022

(54) METHOD OF OPERATING A GASEOUS FUEL INTERNAL COMBUSTION ENGINE

(71) Applicant: Caterpillar Motoren GmbH & Co. KG, Kiel (DE)

(72) Inventors: Eike Joachim Sixel, Kiel (DE); Daniel Wester, Felde (DE); Marius Wolfgramm, Kiel (DE); Robert Graumüller, Kiel (DE); Andre Schmidt, Rostock (DE)

(73) Assignee: Caterpillar Motoren GmbH & Co. KG, Kiel (DE)

( * ) Notice: Subject to any disclaimer, the term of this patent is extended or adjusted under 35 U.S.C. 154(b) by 308 days.

(21) Appl. No.: 16/468,909

(22) PCT Filed: Dec. 11, 2017

(86) PCT No.: PCT/EP2017/082296
§ 371 (c)(1),
(2) Date: Jun. 12, 2019

(87) PCT Pub. No.: WO2018/108846
PCT Pub. Date: Jun. 21, 2018

(65) Prior Publication Data

US 2019/0338714 A1 Nov. 7, 2019

(30) Foreign Application Priority Data

Dec. 15, 2016 (EP) ..... 16204409

(51) Int. Cl.
*F02D 37/02* (2006.01)
*F02D 13/02* (2006.01)
(Continued)

(52) U.S. Cl.
CPC ..... *F02D 37/02* (2013.01); *F02D 13/0246* (2013.01); *F02D 13/0276* (2013.01); *F02D 35/023* (2013.01); *F02D 41/403* (2013.01)

(58) Field of Classification Search
CPC .. F02D 37/02; F02D 13/0246; F02D 13/0276; F02D 35/023; F02D 41/403;
(Continued)

(56) References Cited

U.S. PATENT DOCUMENTS 5,854,990 A 12/1998 Reckzugel et al.
6,230,683 B1 * 5/2001 zur Loye ..... F02D 19/081 123/435
(Continued)

FOREIGN PATENT DOCUMENTS

CN 103782025 5/2014
DE 102008038102 B4 5/2010
(Continued)

OTHER PUBLICATIONS

European Search Report for related Application No. 16204409; reported on May 17, 2017.
(Continued)

*Primary Examiner* — Hung Q Nguyen

(57) ABSTRACT

A method of operating a gaseous fuel internal combustion engine comprises performing at least one measurement relating to the combustion of a mixture of gaseous fuel and air in a combustion chamber of an associated cylinder in a combustion cycle. At least one combustion parameter, for example, a start of combustion, is determined based on the at least one measurement. When the combustion parameter differs from a desired combustion parameter, an ignition device associated with the cylinder is controlled based on the comparison in order to control the combustion in the current combustion cycle.

14 Claims, 2 Drawing Sheets

(51) Int. Cl.
*F02D 35/02* (2006.01)
*F02D 41/40* (2006.01)

(58) Field of Classification Search
CPC .. F02D 41/0027; F02D 35/025; F02D 35/027; F02D 2250/12; F02D 2250/14; F02D 41/405; F02D 19/02; F02D 19/10; Y02T 10/30; Y02T 10/40
See application file for complete search history.

(56) References Cited

U.S. PATENT DOCUMENTS 6,276,334 B1 * 8/2001 Flynn ..... F02D 41/38 123/435
6,912,992 B2 7/2005 Ancimer et al.
7,007,661 B2 3/2006 Warlick
7,325,529 B2 2/2008 Ancimer et al.
7,373,618 B1 5/2008 Khoo et al.
7,422,000 B2 9/2008 Kesse et al.
7,506,535 B2 3/2009 Kang
7,606,655 B2 10/2009 Husted et al.
8,910,615 B2 12/2014 Suzuki
9,399,958 B2 7/2016 Sano et al.
2002/0007816 A1 * 1/2002 Zur Loye ..... F02D 41/403 123/295
2003/0024246 A1 * 2/2003 Beck ..... F02D 41/0027 60/599
2004/0050362 A1 3/2004 Daudel et al.
2004/0118557 A1 * 6/2004 Ancimer ..... F02B 23/0672 166/227
2005/0072402 A1 * 4/2005 Zurloye ..... F02D 41/3047 123/304
2011/0010074 A1 1/2011 Hung et al.
2016/0032853 A1 * 2/2016 Huang ..... F02D 35/024 701/107

FOREIGN PATENT DOCUMENTS

FR 2851300 B1 6/2008
KR 20160041522 4/2016
WO 2013038530 3/2013
WO WO 2014/175821 A1 10/2014

OTHER PUBLICATIONS

International Search Report for related Application No. PCT/EP2017/082296; reported on Feb. 13, 2018.

* cited by examiner

METHOD OF OPERATING A GASEOUS FUEL INTERNAL COMBUSTION ENGINE

TECHNICAL FIELD

The present disclosure generally relates to a gaseous fuel internal combustion engine and a method of operating the same, in particular, to a method of controlling an ignition device of a gaseous fuel internal combustion engine.

BACKGROUND

Generally, a gaseous fuel internal combustion engine, for example, a diesel gas engine, a dual fuel engine or an Otto gas engine, comprises an ignition device configured to ignite a mixture of gaseous fuel and air in a combustion chamber of a cylinder of the internal combustion engine. For example, in a diesel gas engine or a dual fuel engine, a pilot injector may be provided and configured for injecting a pilot amount of liquid fuel, for example, diesel, to facilitate combustion of the mixture of gaseous fuel and air in the combustion chamber. Further, an Otto gas engine may include an ignition device such as a spark plug for igniting the mixture of gaseous fuel and air in the combustion chamber.

The present disclosure is directed, at least in part, to improving or overcoming one or more aspects of prior systems.

SUMMARY OF THE DISCLOSURE

According to one aspect of the present disclosure, a method of operating a gaseous fuel internal combustion engine comprising an ignition device configured to ignite a mixture of gaseous fuel and air in a combustion chamber of a cylinder comprises performing at least one measurement relating to the combustion of the mixture of gaseous fuel and air in the combustion chamber in a combustion cycle of the cylinder. The method further comprises determining at least one combustion parameter based on the at least one measurement, comparing the combustion parameter to a desired combustion parameter, and controlling an ignition by the ignition device in the combustion cycle based on the comparison.

According to another aspect of the present disclosure, a gaseous fuel internal combustion engine comprises an engine block defining at least in part a cylinder, an ignition device configured to ignite a mixture of gaseous fuel and air in a combustion chamber of the cylinder, and a control unit configured to perform the steps of the method according to the above aspect of the present disclosure.

According to yet another aspect of the present disclosure, a computer program comprises computer-executable instructions which, when executed by a computer, cause the computer to perform the steps of the method according to the above aspect of the present disclosure.

Other features and aspects of the present disclosure will be apparent from the following description and the accompanying drawings.

DETAILED DESCRIPTION

Figure 1:
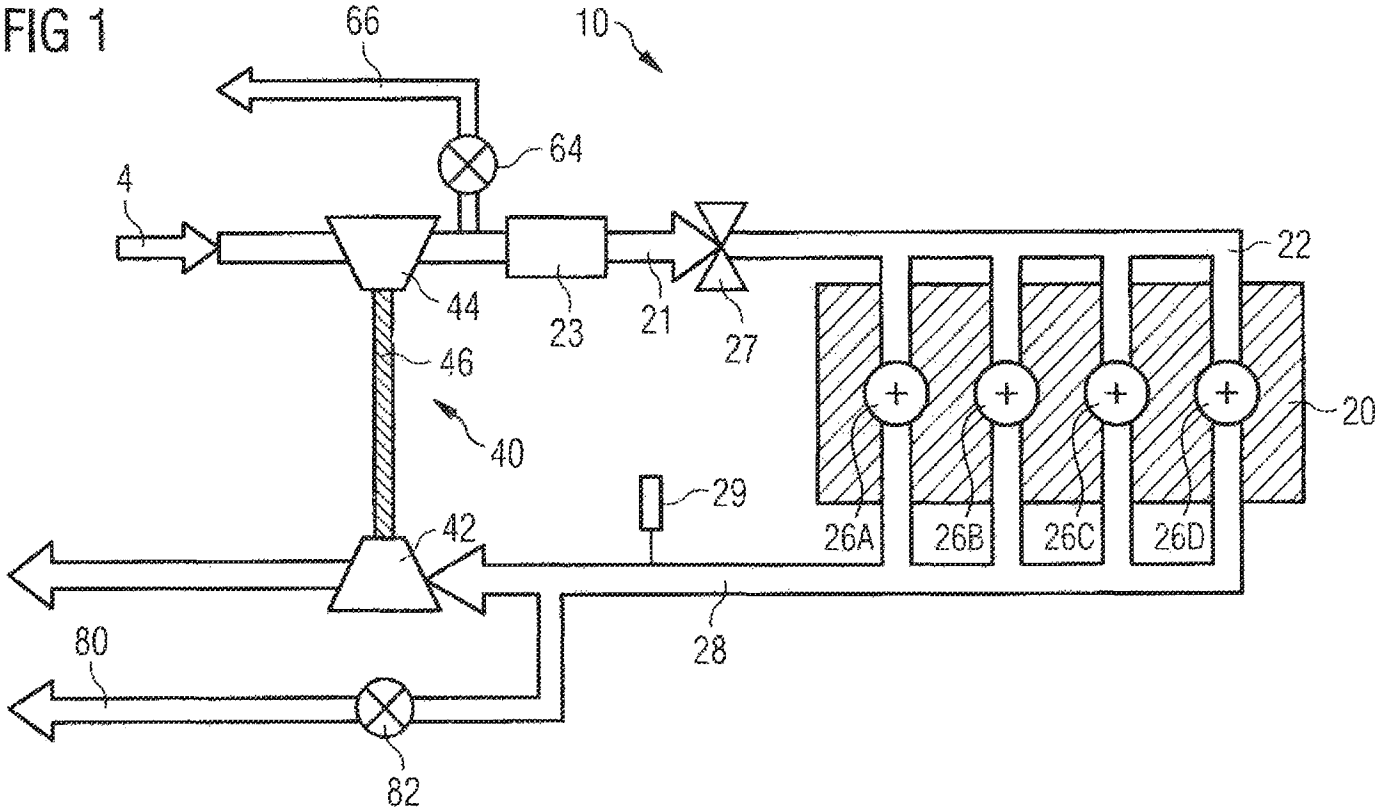
FIG. 1 is a schematic view of an exemplary internal combustion engine in accordance with the present disclosure.

The following is a detailed description of exemplary embodiments of the present disclosure. The exemplary embodiments described herein are intended to teach the principles of the present disclosure, enabling those of ordinary skill in the art to implement and use the present disclosure in many different environments and for many different applications. Therefore, the exemplary embodiments are not intended to be, and should not be considered as, a limiting description of the scope of protection. Rather, the scope of protection shall be defined by the appended claims.

The present disclosure is based at least in part on the realization that, at present, there is no option to influence or control the combustion in a combustion chamber of a gaseous fuel internal combustion engine in a single combustion cycle. Instead, it is only possible to change operating parameters of the engine for a subsequent combustion cycle, for example, based on measurements during a previous combustion cycle.

Accordingly, the present disclosure is based at least in part on the realization that it is possible to use measurements performed during a combustion cycle of a gaseous fuel internal combustion engine for controlling an ignition device associated with a cylinder to control the combustion in the same combustion cycle. In this respect, it has been realized that cylinder pressure measurements can be used in order to calculate characteristic values for the combustion in the cylinder and to determine whether the combustion has developed as expected. If this is not the case, appropriate counter-measures can be taken to control the combustion in the combustion cycle, for example, by controlling the ignition device in an appropriate manner. Accordingly, it is possible to form a shape of the combustion profile in a combustion cycle, for example, in order to achieve a desired cylinder pressure profile associated with the combustion. In this manner, a combustion efficiency, exhaust emissions and an operation stability can be optimized.

The present disclosure is also based at least in part on the realization that a control of the ignition device of the associated cylinder may also be used to react to pre-ignitions in the cylinder. For example, when a pre-ignition, i.e., a start of combustion before an actuation of the ignition device, is detected, the associated ignition device can be deactivated. This will reduce a pressure increase and a load on the affected cylinder. Additionally, the present disclosure may be based at least on part on the realization that a fast pressure relief valve could be provided in the combustion chamber, and could be opened to protect the affected cylinder when a pre-ignition is detected. Further, in case the engine is provided with a variable valve train, the protection of the cylinder could also be achieved by opening the exhaust valve of the same at an appropriate timing.

Further, the present disclosure is based at least in part on the realization that the above-described concept can be applied both to diesel gas engines and Otto gas engines, as well as to dual fuel engines. In this respect, the present disclosure may be based at least in part on the realization that, in case of a diesel gas engine or a dual fuel engine including a pilot injector, an additional pilot injection could be performed, for example, if the start of combustion differs from a desired start of combustion. Likewise, an amount of pilot fuel that is injected, for example, in a second pilot injection, may also be adjusted based on the above-described measurement. On the other hand, in case of an Otto gas engine comprising an ignition device such as a spark plug, one or more further ignitions by the ignition device could be performed when the start of combustion does not match a desired start of combustion. Additionally, a further gas injection and ignition could also be performed, for example, in case the engine is provided with a high pressure gas supply gas system.

Referring now to the drawings, an exemplary embodiment of an internal combustion engine 10 is illustrated in FIG. 1. Internal combustion engine 10 may include features not shown, such as fuel systems, air systems, cooling systems, peripheries, drive train components, etc. In the embodiment, internal combustion engine 10 is a diesel gas engine. One skilled in the art will recognize, however, that internal combustion engine 10 may be any type of gaseous fuel internal combustion engine that utilizes an ignition device for igniting a mixture of gaseous fuel and air for combustion, for example, a dual fuel engine or an Otto gas engine.

Internal combustion engine 10 may be of any size, with any number of cylinders and in any configuration ("V", "in-line", etc.). Internal combustion engine 10 may be used to power any machine or other device, including ships or other marine applications, locomotive applications, on-highway trucks or vehicles, off-highway machines, earth-moving equipment, generators, aerospace applications, pumps, stationary equipment such as power plants, or other engine-powered applications.

Still referring to FIG. 1, internal combustion engine 10 comprises an engine block 20 including a bank of cylinders 26A-26D, a gaseous fuel supply (not shown), a liquid fuel tank (not shown), a turbocharger 40 associated with cylinders 26A-26D, and an intake manifold 22.

Engine block 20 includes a crank-case (not shown) within which a crank-shaft 6 (see FIG. 2) is supported. Crank-shaft 6 is connected to pistons 18 (see FIG. 2) that are movable within each of cylinders 26A-26D during operation of internal combustion engine 10.

Intake manifold 22 is at least temporarily fluidly connected to each of cylinders 26A-26D. Each of cylinders 26A-26D is provided with at least one inlet valve 35 (see FIG. 2) that is adapted to open or close a fluid connection between an intake passage 24 and a corresponding combustion chamber 16 of cylinders 26A-26D.

An exhaust manifold 28 is connected to each of cylinders 26A-26D. Each of cylinders 26A-26D is provided with at least one exhaust valve 36 disposed in an exhaust passage 37 (see FIG. 2) and being configured to open and close a fluid connection between combustion chamber 16 of each cylinder 26A-26D and exhaust manifold 28.

Generally, when internal combustion engine 10 is operated, a mixture of gaseous fuel and air (in the following referred to as the "mixture") is introduced into the combustion chambers of the plurality of cylinders 26A-26D via an air inlet 4, intake manifold 22, inlet valves 35, which supply compressed intake air, and gas admission valves 38 (see FIG. 2), which supply gaseous fuel. After combustion, exhaust gases generated by the combustion process are released from cylinders 26A-26D through exhaust manifold 28.

An exhaust sensor 29 may be disposed in exhaust manifold 28 to detect a component of the exhaust from internal combustion engine 10. In the exemplary embodiment described herein, exhaust gas sensor may be an NOx sensor configured to detect an amount of NOx in the exhaust from internal combustion engine 10.

Turbocharger 40 is configured to use the heat and pressure of the exhaust gas of internal combustion engine 10 to drive a compressor 44 for compressing the intake air prior to being supplied to the engine. Specifically, exhaust gas passing a turbine 42 of turbocharger 40 rotates turbine 42, thereby decreasing in pressure and temperature. Compressor 44 is rotatably connected to turbine 42 via a common shaft 46 and driven by turbine 42.

Generally, an outlet of compressor 44 is fluidly connected to an inlet of intake manifold 22 via a compressor connection 21. As shown in FIG. 1, an outlet of compressor 44 is connected to the inlet of intake manifold 22 via a cooler 23. A throttle valve 27 arranged downstream of cooler 23 is configured to open or close the fluid connection between compressor connection 21 and intake manifold 22, thereby enabling or restricting a flow of the compressed intake air from compressor connection 21 into intake manifold 22.

During operation of internal combustion engine 10, the intake air is compressed and cooled before being supplied to cylinders 26A-26D. Within cylinders 26A-26D, further compression and heating of the mixture may be caused by movement of pistons 18 (see FIG. 2). Then, the mixture within the cylinders 26A-26D may be ignited, for example, by using ignition device 90 for supplying a pilot injection of liquid fuel to initiate the combustion of the mixture at a desired ignition timing. It should be noted that herein the term "ignition timing" may be used for the timing of the start of injection of the pilot fuel by the ignition device 90, or for any other defined point in time during the injection. The produced exhaust gas is discharged via exhaust manifold 28. An outlet of exhaust manifold 28 is fluidly connected to an inlet of turbine 42. An outlet of turbine 42 may be fluidly connected to, for example, an exhaust gas treatment system (not shown).

Additionally, as indicated in FIG. 1, internal combustion engine 10 may be provided with a waste gate system including a waste gate connection 80 and a waste gate valve 82. Further, internal combustion engine 10 may include a blow-off system including a blow-off connection 66 and a blow-off valve 64. It should be appreciated that blow-off connection 66 and blow-off valve 64 may be provided with different configurations than the one shown in FIG. 1, if appropriate. Alternatively, one or more of these components may be omitted.

Figure 2:
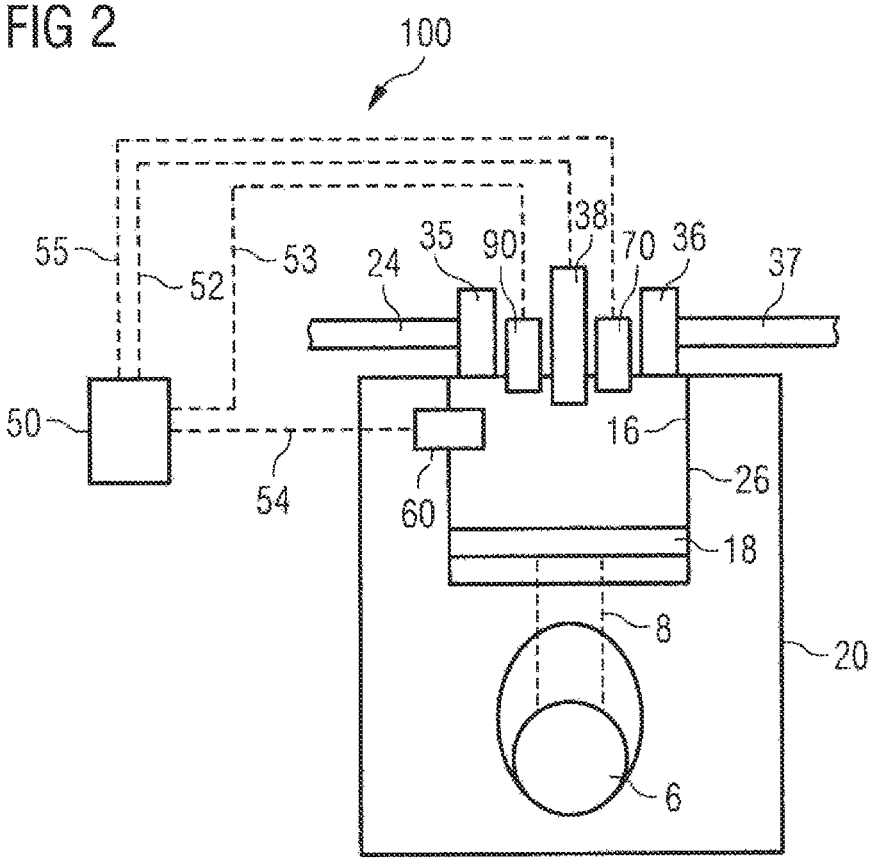
FIG. 2 is a schematic view of a control system in accordance with the present disclosure.

Turning now to FIG. 2, an exemplary embodiment of a control system 100 for controlling the combustion in a cylinder 26 during a combustion cycle is shown. The person skilled in the art will recognize that the exemplary cylinder 26 shown in FIG. 2 demonstrates the principles of the cylinders 26A-26D of FIG. 1. Therefore, the exemplary disclosed configuration shown in FIG. 2 also applies to the cylinders 26A-26D shown in FIG. 1.

FIG. 2 shows a schematic cross-sectional view of cylinder 26. Cylinder 26 defines a combustion chamber 16 and includes a piston 18. Crank-shaft 6 is connected to piston 18 via piston rod 8. Piston 18 is configured to reciprocate within cylinder 26.

Cylinder 26 is connected to intake manifold 22 (FIG. 1) via intake passage 24 and to exhaust manifold 28 via exhaust passage 37. Inlet valve 35 is disposed in intake passage 24, and exhaust valve 36 is disposed in exhaust passage 37. Gas admission valve 38 is provided to supply gaseous fuel to combustion chamber 16 of cylinder 26. In the exemplary embodiment, gas admission valve 38 may be a solenoid-operated gas admission valve (SOGAV). Further, in the exemplary embodiment, a pressure relief valve 70 is provided in combustion chamber 16. In other embodiments, however, pressure relief valve 70 may be omitted.

Inlet valve 35 is configured to supply compressed intake air to combustion chamber 16. Exhaust valve 36 is configured to discharge exhaust from combustion chamber 16 to exhaust manifold 28 after combustion.

Ignition device 90 is configured to ignite the mixture of gaseous fuel and air inside combustion chamber 16 at a desired ignition timing. In the embodiment, ignition device 90 is a pilot injector configured to inject a pilot amount of, for example, diesel fuel to ignite the mixture of gaseous fuel and air in the gas mode. In some embodiments, a pre-combustion chamber (not shown) may be provided in combustion chamber 16, and ignition device 90 may be configured to inject a small amount of fuel into the pre-combustion chamber in order to initiate the combustion of the mixture of gaseous fuel and air in combustion chamber 16.

Control system 100 includes a sensor 60 associated with cylinder 26. Sensor 60 may be disposed at least in part within combustion chamber 16. In other exemplary embodiments, sensor 60 may be disposed outside of combustion chamber 16. Sensor 60 is configured to detect a parameter of the combustion in cylinder 26. In some embodiments, sensor 60 may be a pressure sensor configured to detect a cylinder pressure in cylinder 26. Sensor 60 may be any known pressure sensor and may be configured to detect the pressure within combustion chamber 16 in a known manner. In other embodiments, sensor 60 may be configured to detect temperature fluctuations within combustion chamber 16 or other parameters from which characteristics of the combustion in combustion chamber 16 can be derived. For example, sensor 60 may be an impact sound sensor configured to detect an impact sound propagating in engine block 20 during combustion in combustion chamber 16.

Control system 100 further includes a control unit 50. Control unit 50 is connected to sensor 60 via a communication line 54 and to gas admission valve 38 via a communication line 52. Control unit 50 is further connected to ignition device 90 via a communication line 53 and to pressure relief valve 70 via a communication line 55. Control unit 50 is configured to control an ignition timing of the mixture in combustion chamber 16 via ignition device 90 by injecting a predetermined amount of liquid fuel at a predetermined ignition timing. Further, control unit 50 is configured to receive the results of the detection by sensor 60 and to determine at least one combustion parameter associated with the combustion in combustion chamber 16 from the received detection results.

Control unit 50 may be a single microprocessor or dual microprocessors that include means for controlling, among others, an operation of various components of combustion engine 10. Control unit 50 may be a general engine control unit (ECU) capable of controlling internal combustion engine 10 and/or its associated components. Control unit 50 may include all components required to run an application such as, for example, a memory, a secondary storage device, and a processor such as a central processing unit or any other means known in the art for controlling internal combustion engine 10 and its components. Various other known circuits may be associated with control unit 50, including power supply circuitry, signal conditioning circuitry, communication circuitry and other appropriate circuitry. Control unit 50 may analyze and compare received and stored data and, based on instructions and data stored in memory or input by a user, determine whether action is required. For example, control unit 50 may compare received values with target values stored in memory, and, based on the results of the comparison, transmit signals to one or more components to alter the operation status of the same.

Control unit 50 may include any memory device known in the art for storing data relating to the operation of internal combustion engine 10 and its components. The data may be stored in the form of one or more maps that describe and/or relate, for example, the detection results from sensor 60 and a desired combustion profile for the combustion in combustion chamber 16. Each of the maps may be in the form of tables, graphs and/or equations, and may include a compilation of data collected from lab and/or field operation of internal combustion engine 10. The maps may be generated by performing instrumented tests on the operation of internal combustion engine 10 under various operating conditions while varying parameters associated therewith or performing various measurements. Control unit 50 may reference these maps and control operation of one component in response to the desired operation of another component.

In the embodiment, control unit 50 may have one or more combustion profiles for cylinder 26 stored in the memory of the same, said combustion profiles being determined in advance for a standard or reference operating condition of internal combustion engine 10. For example, each reference combustion profile may be determined under a reference operating condition that corresponds to one or more of a reference fuel quality of the gaseous fuel, a reference ambient air temperature, a reference ambient air pressure, a reference humidity, a reference engine load, and the like. For example, during testing of internal combustion engine 10, internal combustion engine 10 may be operated with a standard fuel of known quality under standard or known ambient conditions such as air temperature, air pressure, humidity, etc. Under these standard conditions, injection timings and injection amounts for one or more injections by ignition device 90 may be varied, until an optimum combustion is obtained. In some embodiments, NOx values associated with the combustion may be taken into account when determining the optimum number of injections and/or injection amounts. In this manner, one or more combustion profiles characterized by, for example, reference cylinder pressure profiles can be obtained for an optimum combustion under different operating conditions.

During operation of in the field, internal combustion engine 10 may be operated using a standard number of injections and corresponding injection amounts for a given ambient air temperature, ambient air pressure, humidity etc. Further, a corresponding reference combustion profile for an optimum or desired combustion is selected in accordance with the current operating condition of internal combustion engine 10.

Next, one or more measurements relating to the combustion in combustion chamber 16 of cylinder 26 are performed. In the embodiment, for example, the in-cylinder pressure measurement by sensor 60 is used to determine at least one combustion parameter, for example, a start of combustion, a center of combustion and/or a combustion duration for the associated combustion event. It will be appreciated that in other embodiments other measurements may be used as an alternative or in addition to the cylinder pressure measurements.

Control unit 50 is configured to compare the at least one combustion parameter based on the at least one measurement to a desired or reference combustion parameter associated with the selected reference combustion profile. Further, control unit 50 is configured to determine whether the determined combustion parameter differs from the desired combustion parameter, for example, by more than a predetermined amount. If so, control unit 50 is configured to take appropriate counter-measures, either to achieve a desired combustion in the current combustion cycle, or to prevent an actuation of ignition device 90 in case a pre-ignition is detected. This will be described in more detail below.

In one example, control unit 50 may be configured to actuate ignition device 90 at a standard ignition timing in order to supply a standard amount of pilot liquid fuel to combustion chamber 16 in order to initiate combustion of the mixture of gaseous fuel and air in combustion chamber 16. For example, control unit 50 may be configured to inject a first amount of liquid fuel at a first ignition timing, for example, a predetermined crank angle before or after top dead center.

Further, control unit 50 may receive pressure measurements from sensor 60, and may continuously compare the received pressure measurement values with desired or reference pressure values associated with the selected reference combustion profile. In addition or as an alternative, control unit 50 may be configured to determine, for example, a start of combustion based on the received pressure measurement values.

In some embodiments, when control unit 50 determines that the actual start of combustion during the current combustion cycle differs from the desired or reference start of combustion, for example, by more than a predetermined amount, control unit 50 may be configured to again actuate ignition device 90 to perform one or more additional pilot fuel injections in order to initiate the combustion. For example, control unit 50 may be configured to actuate ignition device 90 one more time when the start of combustion differs from the desired start of combustion by more than the predetermined amount. Control unit 50 may be configured to immediately perform the additional injection when it is determined that the start of combustion does not match the desired start of combustion, or to perform the additional injection (or several additional injections) at a predetermined timing (or predetermined timings) defined in advance, for example, with respect to the first ignition timing. In some embodiments, control unit 50 may be configured to first perform one additional injection, again evaluate the pressure measurement results received from sensor 60, and perform one or more further injections in case the start of combustion still does not match the desired start of combustion.

Additionally, control unit 50 may be configured to variably control the amount of injected pilot liquid fuel based on the comparison of the determined combustion parameter with the desired combustion parameter. For example, control unit 50 may be configured to adjust the additional amount of pilot fuel that is injected by ignition device 90 based on the difference between the same. In some examples, control unit 50 may be configured to adjust the additional amount of pilot fuel in proportion to the difference between, for example, a detected in-cylinder pressure and a reference cylinder pressure at a given crank angle. In other embodiments, control unit 50 may be configured to vary the additional amount of pilot fuel in proportion to a difference between a determined start of combustion and a desired start of combustion. In some embodiments, control unit 50 may be configured to determine a heat release during the combustion in combustion chamber 16, and compare the determined heat release to a desired heat release, for example, at a predetermined crank angle. In this case, control unit 50 may also be configured to adjust the amount of pilot fuel that is injected based on this comparison.

With the exemplary control described above, control unit 50 is capable of controlling a combustion within a single combustion cycle in order to achieve or approach a desired combustion profile associated with a desired or optimum combustion in a cylinder of internal combustion engine 10. In this manner, a combustion efficiency, exhaust emissions, etc. can be optimized.

In another example, control unit 50 may be configured to perform the at least one measurement associated with cylinder 26 prior to a first actuation of ignition device 90 in a combustion cycle of cylinder 26. For example, control unit 50 may be configured to receive the measured cylinder pressure from sensor 60, and determine based on the received cylinder pressure values whether a pre-ignition is occurring in cylinder 26, i.e., whether the mixture of gaseous fuel and air in combustion chamber 16 is ignited even though ignition device 90 has not yet supplied any pilot fuel. If so, control unit 50 is configured to abort the injection of pilot fuel by ignition device 90 (deactivate the same) in order to reduce a pressure increase and a load on cylinder 26.

Additionally, control unit 50 may be configured to open pressure relief valve 70 when a start of combustion is detected prior to the actuation of ignition device 90, i.e., in case of a pre-ignition. It will be appreciated that any appropriate pressure relief valve having a switching time that is fast enough can be used to achieve the desired effect.

As an alternative or in addition, control unit 50 may further be configured to open exhaust valve 36 of cylinder 26 in case of a detected pre-ignition, for example, for engines that are provided with a variable valve train. Again, it will be appreciated that any appropriate actuation mechanism that allows actuation of exhaust valve 36 at variable timings can be used.

In the above-described embodiment, gaseous fuel internal combustion engine 10 is a diesel gas engine. It will be readily appreciated, however, that the above-described control by control unit 50 can also be implemented in case of a dual fuel engine operating in gas mode.

In addition, it will be readily appreciated that the above-described control can be implemented for an Otto gas engine including an ignition device 90 such as, for example, a spark plug that is configured to ignite the mixture of gaseous fuel and air in combustion chamber 16 by generating an ignition spark at a desired ignition timing. In this case, control unit 50 may be configured to actuate ignition device 90 prior to performing the at least one measurement, and to actuate ignition device 90 at least one more time during the same combustion cycle, for example, when the combustion parameter differs from the desired combustion parameter by more than the predetermined amount. For example, control unit 50 may be configured to actuate ignition device 90 for a second time in case no start of combustion is detected after a first actuation. Of course, this can be repeated, if necessary, i.e., control unit 50 may also actuate ignition device 90 for a third time, and so on.

Likewise, in case of detection of a pre-ignition, control unit 50 may be configured to deactivate ignition device 90, i.e., prevent generation of the ignition spark by the same.

In case gaseous fuel internal combustion engine 10 is provided with a high pressure gas supply system, control unit 50 may also be configured to actuate gas supply valve 38 to supply an additional amount of gaseous fuel in combination with the additional actuation of ignition device 90. For example, in case of an Otto gas engine, a gas supply valve close to the ignition device may supply an additional amount of gaseous fuel, and the ignition device of the engine may perform a second ignition in the same combustion cycle when the combustion parameter differs from the desired combustion parameter by more than the predetermined amount. Control unit 50 may be configured to synchronize the additional gas injection with the additional ignition, or to supply the additional gas injection at a predetermined timing with respect to the additional ignition, for example, a predetermined crank angle before the same.

It will be appreciated that, apart from the above-described differences between an Otto gas engine and a diesel gas engine, the remaining control by control unit 50 in accordance with the present disclosure may be the same for both engine types.

INDUSTRIAL APPLICABILITY

The industrial applicability of the systems and methods for controlling the combustion during a combustion cycle of gaseous fuel internal combustion engine described herein will be readily appreciated from the foregoing discussion. An exemplary machine suited to the disclosure is a large internal combustion engine such as the engines of the series M46DF, M43DF, GCM46, GCM34, M32DF, M34DF, M27DF, GCM27, M3x manufactured by Caterpillar Motoren GmbH & Co. KG, Kiel, Germany. Similarly, the systems and methods described herein can be adapted to a large variety of other gas or dual fuel engines used for various different tasks.

With the system of the present disclosure, it is possible to form the shape of the combustion profile in a cylinder of a gaseous fuel internal combustion engine in a single combustion cycle. As mentioned above, this can improve the efficiency of the combustion, reduce exhaust emissions, and increase the operation stability of the engine. An exemplary method of controlling the gaseous fuel internal combustion engine is described in the following.

During operation of the gaseous fuel internal combustion engine 10, control unit 50 may actuate ignition device 90 at a predetermined ignition timing, for example, a predetermined crank angle, in order to inject a predetermined amount of ignition fuel or to actuate an ignition device such as a spark plug or the like.

Sensor 60 measures the in-cylinder pressure of associated cylinder 26. Control unit 50 receives the measured cylinder pressure values, and determines whether the measured values correspond to reference values associated with, for example, a desired combustion profile for cylinder 26.

In case the values do not match, for example, when a start of combustion is retarded with respect to a desired start of combustion, control unit 50 is configured to perform an appropriate counter-measure. For example, in case of a diesel gas engine, control unit 50 may be configured to perform a second injection of pilot fuel at an appropriate timing in order to further promote combustion of the mixture of gaseous fuel and air in combustion chamber 16. In this respect, control unit 50 may also be configured to adjust the amount of additional pilot fuel that is injected based on, for example, a comparison between a current heat release and a desired heat release associated with the combustion, for example, at a predetermined crank angle. Here, the timing of the additional injection and/or the amount of the additional injection can be determined in advance for a variety of combustion profiles determined by control unit 50. For example, appropriate timings and/or injection amounts may be related to the difference between the measured cylinder pressure and the desired cylinder pressure in one or more maps, and may be selected by control unit 50 by utilizing said maps. Of course, the same applies for the additional ignition timings in case of an Otto gas engine.

As an alternative or an addition, in one exemplary method disclosed herein, control unit 50 may also be configured to determine based on the received cylinder pressure measurements from sensor 60 whether a pre-ignition has occurred in combustion chamber 16. If so, control unit 50 is configured to deactivate ignition device 90, i.e., prevent the ignition of pilot fuel in case of a diesel gas engine, or prevent actuation of the spark plug of an Otto gas engine.

It will be appreciated that the foregoing description provides examples of the disclosed systems and methods. However, it is contemplated that other implementations of the disclosure may differ in detail from the foregoing examples. All references to the disclosure or examples thereof are intended to reference the particular example being discussed at that point and are not intended to imply any limitation as to the general disclosure.

Recitation of ranges of values herein are merely intended to serve as a shorthand method for referring individually to each separate value falling within the range, unless otherwise indicated herein, and each separate value is incorporated into the specification as if it were individually recited herein. All method steps described herein can be performed in any suitable order, unless otherwise indicated or clearly contradicted by the context.

Although the preferred embodiments of the present disclosure have been described herein, improvements and modifications may be incorporated without departing from the scope of the following claims.

The invention claimed is:

1. A method of operating a gaseous fuel internal combustion engine, the internal combustion engine comprising an ignition device configured to ignite a mixture of gaseous fuel and air in a combustion chamber of a cylinder, the method comprising:

performing at least one measurement relating to the combustion of the mixture of gaseous fuel and air in the combustion chamber in a combustion cycle of the cylinder;

determining at least one combustion parameter based on the at least one measurement;

comparing the combustion parameter to a desired combustion parameter; and controlling an ignition by the ignition device in the combustion cycle based on the comparison.

2. The method of claim 1, further comprising:

actuating the ignition device prior to performing the at least one measurement; and actuating the ignition device at least one more time in the combustion cycle when the combustion parameter differs from the desired combustion parameter by more than a predetermined amount.

3. The method of claim 2, further comprising:

determining a start of combustion in the cylinder based on the at least one measurement; and actuating the ignition device the at least one more time when the start of combustion differs from the desired start of combustion by more than the predetermined amount, or when no start of combustion is detected for a predetermined period of time after first actuating the ignition device.

4. The method of claim 3, further comprising:

performing the at least one measurement prior to a first actuation of the ignition device in the combustion cycle; and deactivating the ignition device when a start of combustion is detected based on the at least one measurement.

5. The method of claim 4, further comprising:

providing a pressure relief valve in the combustion chamber; and opening the pressure relief valve when the start of combustion is detected prior to the first actuation of the ignition device.

6. The method of claim 5, further comprising opening an exhaust valve of the cylinder when the start of combustion is detected prior to the first actuation of the ignition device.

7. The method claim 6, wherein the gaseous fuel internal combustion engine is a diesel gas engine, the ignition device being configured to inject a pilot amount of liquid fuel for combusting the mixture of gaseous fuel and air in the combustion chamber, the method comprising:

performing a first injection by the ignition device prior to performing the at least one measurement; and performing a second injection by the ignition device in the combustion cycle when the combustion parameter differs from the desired combustion parameter by more than a predetermined amount, and, optionally, performing at least one more additional injection when the combustion parameter still differs from the desired combustion parameter by more than the predetermined amount after the second injection.

8. The method of claim 7, further comprising adjusting an amount of liquid fuel injected in the second injection based at least in part on the difference between the combustion parameter and the desired combustion parameter.

9. The method of claim 8, further comprising:

determining a heat release during the combustion in the combustion cycle as the combustion parameter;

comparing the determined heat release to a desired heat release at a predetermined crank angle; and adjusting the amount of liquid fuel based on the comparison.

10. The method of claim 1, wherein the gaseous fuel internal combustion engine is an Otto gas engine, the ignition device being configured to ignite the mixture of gaseous fuel and air in the combustion chamber, the method comprising:

actuating the ignition device prior to performing the at least one measurement; and actuating the ignition device at least one more time in the combustion cycle when the combustion parameter differs from the desired combustion parameter by more than a predetermined amount.

11. The method of claim 10, wherein the gaseous fuel internal combustion engine comprises a gas supply valve configured to supply gaseous fuel to the combustion chamber, the method further comprising supplying an additional amount of gaseous fuel to the combustion chamber via the gas supply valve in the combustion cycle when the combustion parameter differs from the desired combustion parameter by more than the predetermined amount.

12. The method of claim 11, wherein the at least one measurement includes a cylinder pressure measurement of the pressure in the cylinder.

13. A gaseous fuel internal combustion engine comprising:

an engine block defining at least in part a cylinder;

an ignition device configured to ignite a mixture of gaseous fuel and air in a combustion chamber of the cylinder; and a control unit configured to perform the steps of the method of claim 12.

14. A computer program comprising computer-executable instructions which, when executed by a computer, cause the computer to perform the steps of the method of claim 12.

* * * * *